United States Patent [19]

Dorfeld et al.

[11] 4,298,505

[45] Nov. 3, 1981

[54] RESISTOR COMPOSITION AND METHOD OF MANUFACTURE THEREOF

[75] Inventors: William G. Dorfeld, Lindley; Robert J. Settzo, Painted Post, both of N.Y.

[73] Assignee: Corning Glass Works, Corning, N.Y.

[21] Appl. No.: 91,375

[22] Filed: Nov. 5, 1979

[51] Int. Cl.[3] ..... H01B 1/06

[52] U.S. Cl. ..... 252/513; 252/512; 252/519; 427/102; 427/103; 427/258; 427/294; 338/308; 29/610 R; 29/620; 29/621

[58] Field of Search ..... 252/512, 513, 519, 518; 427/101, 103, 102, 250–252, 258, 282, 294, 383; 338/308; 75/171; 204/192 R, 298; 29/610 R, 620, 621; 156/657, 659, 662

[56] References Cited

U.S. PATENT DOCUMENTS

| | | | |
|---|---|---|---|
| 3,477,935 | 11/1969 | Hall | 75/171 |
| 3,591,479 | 7/1971 | Stern | 204/192 |
| 4,021,277 | 5/1977 | Shirn | 338/308 |
| 4,073,971 | 2/1978 | Yasujim | 252/513 |
| 4,100,524 | 7/1978 | Kirsch | 252/513 |
| 4,204,935 | 5/1980 | Klesse | 252/513 |

*Primary Examiner*—J. L. Barr

*Attorney, Agent, or Firm*—Walter S. Zebrowski; Dale M. Heist

[57] ABSTRACT

Disclosed is a range of resistor compositions which exhibit a stability of less than 0.5 percent change in resistance after 2,000 hours at 175° C., and yet which also have a temperature coefficient of resistance less than + or −25 ppm per degree Celsius. These compositions all comprise alloys of nickel, chromium and silicon, within a selected range. Also, disclosed is a method of manufacturing these compositions on a reproducible basis. The method includes the provision of a first silicon target and a second nickel chromium target and the subjecting of these targets to a sputtering gas and electrical potential such that the aforementioned silicon, nickel, chromium alloys are formed.

14 Claims, 1 Drawing Figure

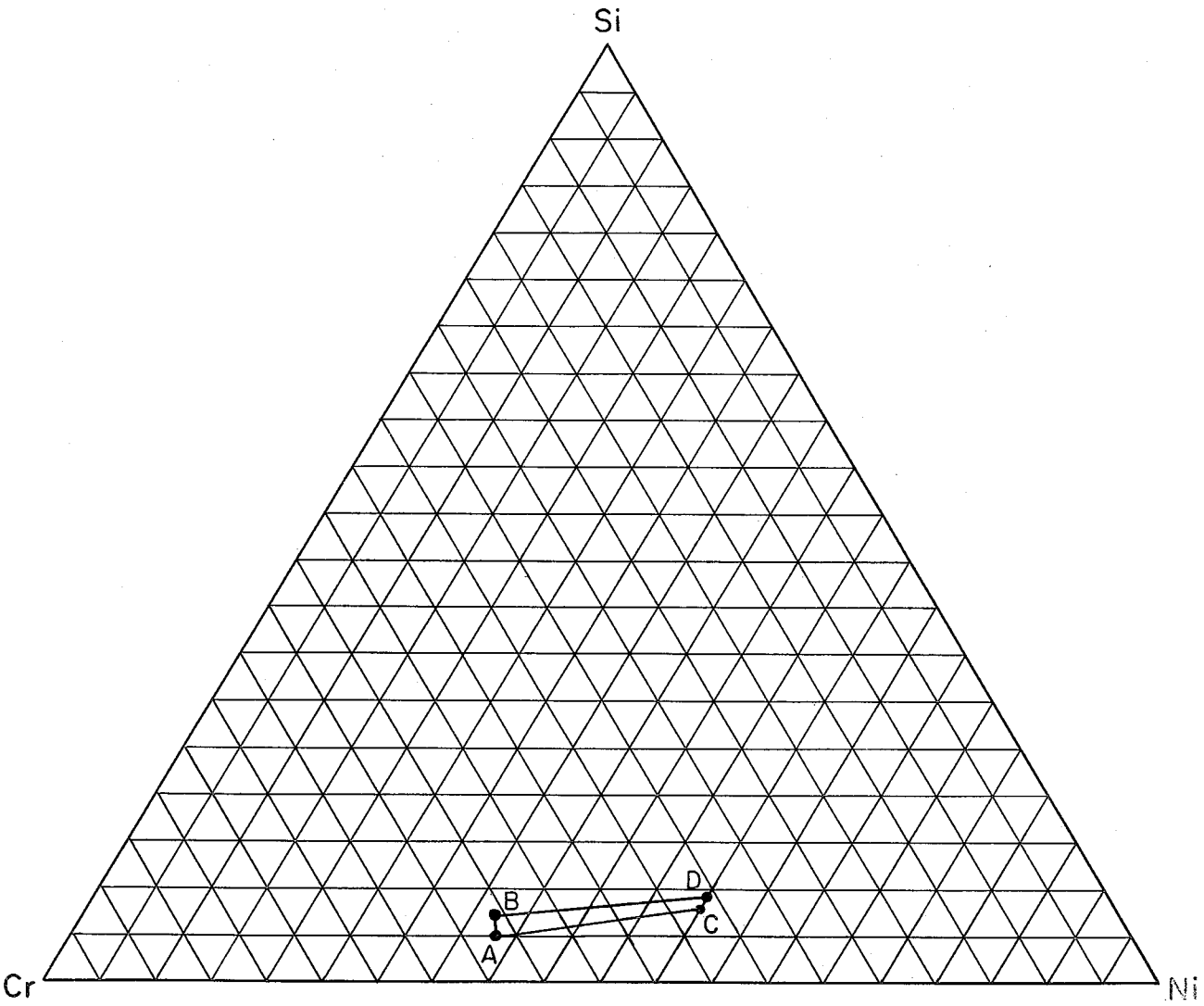
Si
Ni
Cr
A
B
C
D

RESISTOR COMPOSITION AND METHOD OF MANUFACTURE THEREOF

BACKGROUND OF THE INVENTION

This invention relates in general to a novel resistor composition and to a method of producing such composition. Nickel-chromium alloys are extensively used as the resistive medium in discrete film resistors and in hybrid circuitry. These alloys are employed not only because of their high resistivity but also because they exhibit acceptable stability at elevated temperatures and because they can be deposited with a low temperature coefficient of resistance (TCR). They do not necessarily have a low coefficient of resistance unless properly deposited.

Stability may be defined as the change in resistance of a resistor composition with time. TCR may be defined as the reversible fractional change in resistance of a resistor composition with temperature.

While nickel-chromium alloys are acceptable for many purposes, over the years, the requirements for premium quality, precision resistors have been gradually tightened. One requirement which modern resistors for specialized applications are required to meet is that they exhibit a stability defined as being less than 0.5 percent change in resistance after they have withstood 2,000 hours at 175° C. in air. Moreover, in addition to this stability requirement, it is desirable that modern resistors for specialized applications have a temperature coefficient of resistance, or TCR, which meets a minimum standard of $0\pm(25\times10^{-6})$°C.$^{-1}$. Those skilled in the art will appreciate that such a TCR standard may also be stated as ±25 ppm °C./$^{-1}$. Such a standard has been incorporated into the current military specifications namely MIL 55182.

With standard binary nickel-chromium alloys, stability within the above-range, i.e., less than 0.5 percent change in resistance after 2,000 hours, may be obtained with a high percentage of nickel in the composition such as, for example, 80 percent nickel, 20 percent chromium by weight. However, with such a resistor composition, TCR is excessive, usually in the range of several hundred ppm °C.$^{-1}$. Increasing the chromium concentrations drives the TCR closer to 0, but at the expense of stability.

It is a specific object of the present invention, to provide novel resistor compositions which meet the foregoing stability requirements and yet which exhibit less than ±25 ppm °C. TCR, and thus which fall within the aforementioned military specification.

Moreover, it is a further object of the invention to provide such resistor compositions and a method of producing the same which is reproducible such that predictable resistors may be obtained within the above standards on a production basis.

SUMMARY OF THE INVENTION

In accordance with the present invention, a third element, namely silicon, is introduced into the aforementioned nickel-chromium alloys. It has been discovered that the relative proportions of nickel, chromium, and silicon must lie within a specific range such that both the aforementioned stability and TCR standards are met.

The aforementioned range of nickel, chromium and silicon concentrations will be better appreciated by reference to the accompanying drawing which comprises a triangular coordinate plot showing the range of weight percentages of nickel, chromium and silicon employed in the present invention.

DETAILED DESCRIPTION OF THE INVENTION

Referring specifically to the drawing, a first polygon AB, BD, DC, CA is shown.

By experimentation, the present applicants have shown that a resistor composition at point A, namely a composition of 38 percent nickel, 57 percent chromium and 5 percent silicon, by weight, exhibits the aforementioned stability requirements. In other words, applicants have determined that at a point A, a resistor composition exists which exhibits a stability of less than 0.5 percent change in resistance after 2,000 hours at 175° C. in air. Moreover, the applicants have determined that point A represents a resistor composition having an average temperature coefficient of resistance of −16 ppm °C.$^{-1}$, which is well within the aforementioned military specification, MIL 55182. The average sheet resistance was 130 ohms per square.

Likewise, it has been found that at point B, a composition of 37 percent nickel, 56 percent chromium, and 7 percent silicon meets the aforementioned stability standard of less than 5 percent change in resistance after 2,000 hours at 175° C. in air. Moreover, this composition exhibits an average temperature coefficient of −10 ppm °C.$^{-1}$, again well within MIL 55182. The average sheet resistance was 1100 ohms per square.

At point C, a composition exists of 55 percent nickel, 37 percent chromium, and 8 percent silicon which exhibits the aforementioned stability requirement. Moreover, this composition also exhibits an average temperature coefficient of resistance of −20 ppm °C.$^{31\ 1}$. The average sheet resistance was 125 ohms per square.

Finally, at point D, a composition has been found to exist of 55 percent nickel, 36 percent chromium and 9 percent silicon by weight which meets the aforementioned stability standard and which exhibits a temperature coefficient of resistance of −6 ppm °C.$^{-1}$. The average sheet resistance was 290 ohms per square.

In addition to the points A, B, C, and D mentioned above, applicants have also verified that a number of points lying along the lines AB and CD exhibit the aforementioned stability and TCR requirements.

In accordane with the present invention, compositions along the lines AB, CD, BD and AC and compositions within the polygon ABCD have improved stability and TCR characteristics. Applicants have determined that a number of compositions outside the polygon AB, BD, DC, CA do not exhibit the aforementioned characteristics.

The resistor compositions which exhibited the aforementioned improved stability and TCR characteristics were manufactured by the following method. Metal films were deposited by dual cathode planar magnetron sputtering using commercial deposition equipment (Airco-Temescal type HRC373). High purity silicon comprised one target. A chromium-nickel alloy comprised the other target. An electrical potential was applied to the targets to obtain sputtering. The actual composition obtained was adjusted by controlling the sputtering power to the individual targets. The actual composition was measured by quantitative auger electron spectroscopy. A large number of ceramic resistor substrates (Rosenthal Thomit) were agitated in the path of the sputtered material to obtain a uniform coating.

The sputtering gas employed was a blend of 1 percent oxygen in argon. The gas was varied in pressure between 0.3 Pa to 0.7 Pa. Moreover, the gas had a flow rate of 50 cubic centimeters per minute.

After the substrates were coated with a metal film, they were removed to a vacuum evaporator and coated with silicon monoxide and then heat treated in air. The exemplary high chromium content compositions, namely 5 percent silicon, 57 percent chromium, 38 percent nickel by weight, and 7 percentsilicon, 56 percent chromium and 37 percent nickel by weight, were heat treated at 450° C. for four hours in air. These exemplary high nickel content compositions, namely 8 percent silicon, 37 percent chromium, 55 percent nickel by weight and 9 percent silicon, 36 percent chromium, 55 percent nickel by weight, were heat treated at 350° C. for 16 hours. The blanks were then spiraled, and terminals were attached in accordance with standard practice.

The reason that the aforementioned compositions defined by the polygon BD, DC, CA and AB, ABCD are believed to have adequate stability is because stability is related to the extent of oxidation of the surface of a resistive film. It is believed that the introduction of a third element into a binary nickel-chromium alloy film, namely silicon, alters the surface chemistry in such a way that a different oxide or at least a mixed oxide is formed which has a more favorable passivation characteristic than the oxide $Cr_2O_3$, formed on the surface of a standard binary nickel-chromium alloy film.

By improving the passivation of the resistor film less metal is converted to oxide, and there is less effect on metal film composition. Generally, in a binary Ni-Cr film chromium is preferentially oxidized which leaves the remaining metal enriched in nickel. This produces a positive TCR change during heat treatment. The improved passivation attainable with the abovementioned compositions limits the positive shift during heat treatment while at the same time providing a starting TCR which is not excessively negative. The resulting resistor TCR is therefore near zero.

While particular embodiments of the present invention have been described, it will of course, be understood that various modifications may be made without departing from the principle of the present invention. The appended claims are, therefore, intended to cover any such modifications within the true spirit and scope of the invention.

What is claimed is:

1. A resistor having improved stability and temperature coefficient of resistance consisting essentially of nickel, chromium and silicon, the concentration by weight of each being in the ranges specified by the polygon AB, BD, DC, CA as shown in the drawing.

2. The resistor composition of claim 1 wherein the relative proportions of nickel, chromium and silicon consist essentially of 5 percent silicon, 57 percent chromium, and 38 percent nickel by weight.

3. The resistor composition of claim 1 wherein the relative proportions of nickel, chromium and silicon consist essentially of 7 percent silicon, 56 percent chromium, and 37 percent nickel by weight.

4. The resistor composition of claim 1 wherein the relative proportions of nickel, chromium and silicon consist essentially of 8 percent silicon, 37 percent chromium, and 55 percent nickel by weight.

5. The resistor composition of claim 1 wherein the relative proportions of nickel, chromium and silicon consist essentially of 9 percent silicon, 36 percent chromium and 55 percent nickel by weight.

6. A method of manufacturing a resistor comprising the steps of:

providing a first target of high purity silicon;

providing a second target of chromium, nickel alloy;

providing a substrate;

subjecting said first target and said second target to a sputtering gas and electrical potential so as to deposit an alloy of nickel, chromium and silicon on said substrate;

adjusting the sputtering power applied by said electrical potential such that the concentrations by weight of nickel, chromium and silicon in said alloy are each within ranges specified by the polygon, AB, BD, DC, CA as shown in the drawing.

7. A method of claim 6 wherein said sputtering gas comprises 1 percent oxygen in argon.

8. The method of claim 7 wherein the pressure of said sputtering gas ranges between 0.3 to 0.7 Pa.

9. The method of claim 8 wherein said sputtering gas has a flow rate of 50 cubic centimeters per minute.

10. The method of claim 6 further comprising the step of:

coating said alloy deposited substrate with silicon monoxide.

11. The method of claim 10 further comprising the step of:

heat treating the coated alloy substrate.

12. The method of claim 11 wherein said heat treating step comprises subjecting said substrate to a temperature of 350 C. in air for sixteen hours.

13. The method of claim 11 wherein said heat treating step comprises subjecting said substrate to a temperature of 450° C. in air for four hours.

14. A resistor having improved stability and temperature coefficient of resistance consisting essentially of nickel in the range which includes from 37 percent to 55 percent by weight, chromium in the range which includes 36 percent to 57 percent by weight, and silicon in the range which includes 5 percent to 9 percent by weight.

* * * * *

UNITED STATES PATENT AND TRADEMARK OFFICE

CERTIFICATE OF CORRECTION

PATENT NO. : 4,298,505

DATED : November 3, 1981

INVENTOR(S) : William G. Dorfeld and Robert J. Settzo

It is certified that error appears in the above—identified patent and that said Letters Patent is hereby corrected as shown below:

Column 1, line 45, "concentrations" should be -- concentration --.

Column 2, line 36, "$°C.^{31\ 1}$" should be -- $°C.^{-1}$ --.

Signed and Sealed this

*Twenty-third* Day of *March 1982*

[SEAL]

*Attest:*

GERALD J. MOSSINGHOFF

*Attesting Officer* *Commissioner of Patents and Trademarks*